US008882339B2

(12) United States Patent
Colpo et al.

(10) Patent No.: US 8,882,339 B2
(45) Date of Patent: Nov. 11, 2014

(54) IMMOBILIZING DEVICE FOR A TOOTHED WHEEL

(75) Inventors: Fabiano Colpo, Lausanne (CH); Simon Henein, Neuchatel (CH)

(73) Assignee: Rolex S.A., Geneva (CH)

( * ) Notice: Subject to any disclaimer, the term of this patent is extended or adjusted under 35 U.S.C. 154(b) by 75 days.

(21) Appl. No.: 13/637,697

(22) PCT Filed: Mar. 31, 2011

(86) PCT No.: PCT/CH2011/000067

§ 371 (c)(1),
(2), (4) Date: Dec. 5, 2012

(87) PCT Pub. No.: WO2011/120180

PCT Pub. Date: Oct. 6, 2011

(65) Prior Publication Data

US 2013/0070570 A1 Mar. 21, 2013

(30) Foreign Application Priority Data

Apr. 1, 2010 (EP) ..... 10405072

(51) Int. Cl.

| | |
|---|---|
| ***G04B 15/00*** | (2006.01) |
| ***G04B 15/12*** | (2006.01) |
| ***G04D 3/00*** | (2006.01) |
| ***G04B 15/06*** | (2006.01) |
| ***G04B 15/14*** | (2006.01) |

(52) U.S. Cl.

CPC ..... *G04B 15/00* (2013.01); *G04B 15/12* (2013.01); *G04D 3/00* (2013.01); *G04B 15/06* (2013.01); *G04B 15/14* (2013.01)

USPC ..... 368/127; 368/132

(58) Field of Classification Search

USPC ..... 368/124–125, 127–132; 29/896.3

See application file for complete search history.

(56) References Cited

U.S. PATENT DOCUMENTS 244,684 A * 7/1881 Chiuve et al. ..... 368/127
725,037 A * 4/1903 Buysse ..... 368/127

(Continued)

FOREIGN PATENT DOCUMENTS

| | | | |
|---|---|---|---|
| CH | 437 146 | A | 2/1967 |
| EP | 1 710 636 | A1 | 10/2006 |
| EP | 2 037 335 | A2 | 3/2009 |

OTHER PUBLICATIONS

International Search Report of PCT/CH2011/000067, mailing date Jun. 7, 2011.

*Primary Examiner* — Sean Kayes

(74) *Attorney, Agent, or Firm* — Westerman, Hattori, Daniels & Adrian, LLP

(57) ABSTRACT

The invention relates to an immobilizing device for a toothed wheel suitable for the field of horology where it can be part of a direct- or indirect-impulse escapement, in particular in a wristwatch. This immobilizing device (1, 2, 3, 4, 5, 6) comprises: —a base (7); —an immobilizer (9) comprising two arms (10, 11) each provided with a pallet (14, 15) intended to come into contact with a tooth of the toothed wheel (40); —a first and a second elastic element (12, 13) each having an end connected to the immobilizer (9) and another end connected to the base (7); —a third elastic element (16) connected to the immobilizer (9), and it has the particular feature that it is in one piece or in one piece apart from at least one of the pallets (14, 15). The invention also relates to a timepiece and to a method for assembling such a timepiece.

18 Claims, 12 Drawing Sheets

(56) References Cited

U.S. PATENT DOCUMENTS

| | | | | |
|---|---|---|---|---|
| 2,481,213 | A * | 9/1949 | Gummersall | 368/124 |
| 2,531,273 | A * | 11/1950 | Jaccard | 368/127 |
| 2,706,884 | A * | 4/1955 | Fidelman | 368/127 |
| 3,677,101 | A * | 7/1972 | Blitz | 74/112 |
| 7,458,717 | B2 * | 12/2008 | Baumberger et al. | 368/127 |
| 8,087,819 | B2 * | 1/2012 | Chiuve et al. | 368/127 |
| 8,540,418 | B2 * | 9/2013 | Richard et al. | 368/128 |
| 2008/0279052 | A1 | 11/2008 | Rochat et al. | |

* cited by examiner

IMMOBILIZING DEVICE FOR A TOOTHED WHEEL

The invention relates to an immobilizing device for a toothed wheel, which device is designed in particular for the micromechanical field. The device is well suited to the horology field where it may, for example, form part of a direct or indirect impulse escapement, notably in a wrist watch.

BACKGROUND OF THE INVENTION

In the horology field, a watch mechanism called an "escapement" has been used for centuries and its purpose is to maintain and count the oscillations of the balance wheel or of the pendulum of the timepiece. Accordingly, the mechanism periodically communicates a portion of the motive energy of a barrel, by means of a toothed wheel called an "escapement wheel" to the regulating member (balance-hair spring or pendulum) of the watch or clock. When this toothed wheel is not in motion, it is immobilized by a mobile called a "lever" or "immobilizer" depending on the type of escapement used.

The major drawback of this escapement is that the movements of said mobile take place with considerable functional clearances which negatively effects the performance of the escapement.

Figure 7:
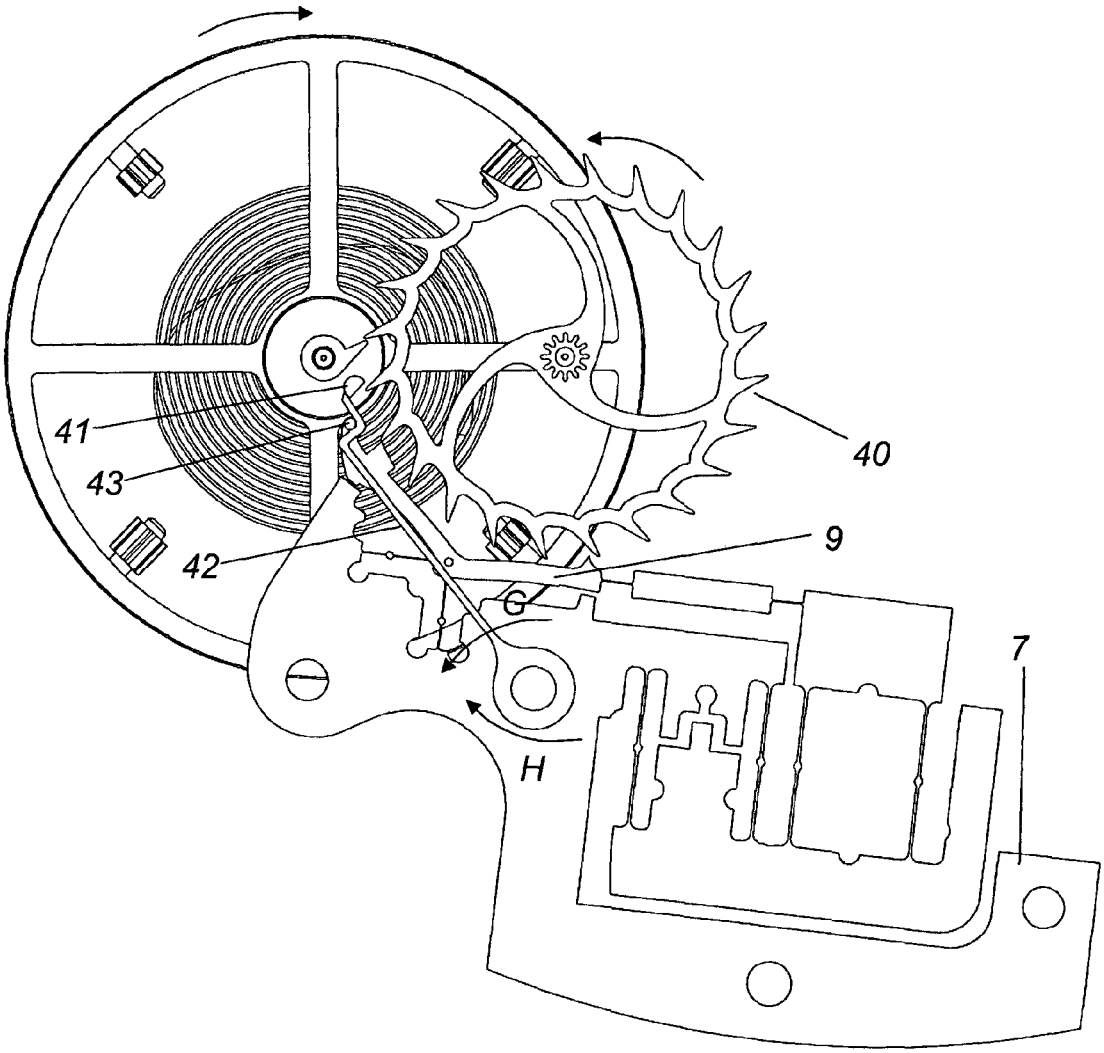
Figure 8:
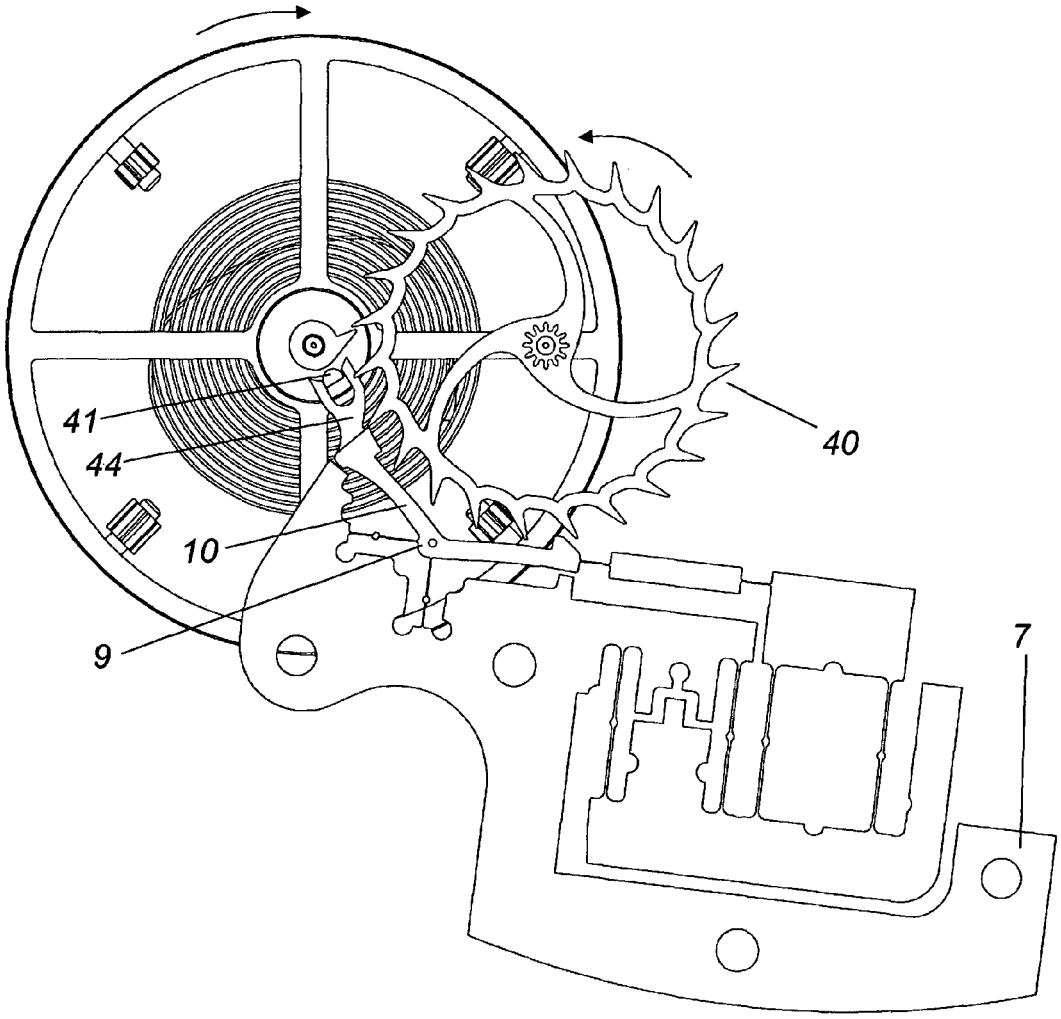

European patent application No. EP 2 037 335 A2 relates to a lever for a watch escapement. In FIGS. 7 and 8 of this patent application there is a representation of a lever comprising two attachment arms (numbered 7) and an elastic spring provided to be acted upon in tension (numbered 10). These three elements are linked to the connection zone (numbered 6) of the two arms (numbered 2) of the lever and they are all three situated on one and the same side of the lever. The attachment arms are identical; between them they form an acute angle and each comprise at their free end an annular eyelet (numbered 8). The spring is placed between them, at an equal distance from one and from the other, and it is furnished at its free end with an attachment plate (numbered 11) having an oblong hole (numbered 12).

Such a lever is very difficult to attach with precision. Specifically, each of the two eyelets must be attached separately and then the attachment plate must be attached, since the latter must be able to be tightened adjustably with a screw. It is also necessary to provide sufficient space around the attachment plate to be able to adjust its position. Moreover, this lever is extremely sensitive to the dimensional variations of its constituent parts, which must then have very restricted manufacturing tolerances.

SUMMARY OF THE INVENTION

The main object of the invention is to minimize, or even eliminate, the clearances associated with the movement of a mobile controlling the rotation of a toothed wheel so as to increase the performance of the mechanism of which this toothed wheel forms part. This must be able to be done simply and precisely.

This object is achieved by means of an immobilizing device the essential features of which are set out in point 1 below:

1. An immobilizing device for a toothed wheel comprising:
   - a frame;
   - an immobilizer comprising two arms each furnished with a pallet designed to come into contact with a tooth of the toothed wheel;

- a first and a second elastic element each having one end connected to the immobilizer and another end connected to the frame;
   - a third elastic element connected to the immobilizer, this immobilizing device being all in one block or all in one block except for at least one of the pallets.

Thus, by virtue of these features, the immobilizing device according to the invention allows an improved relative positioning of all the constituent parts of the mechanism. In this way it can be flat, which makes it attachment easier. Moreover, it can be manufactured with greater tolerances which makes it less awkward to manufacture.

For those skilled in the art, the immobilizing device according to the invention is similar to a lever or to an immobilizer for a clockwork escapement. It is not truly an escapement because it does not have all the constituent members (see "Dictionnaire professionnel illustré de l'horlogerie I+II" (Illustrated Professional Dictionary of Horlogerie I+II) by G.-A. Berner).

Additional advantageous features of the immobilizing device according to the invention defined in point 1 above are set out in points 2 to 15 below:

2. —The immobilizing device for a toothed wheel according to point 1, wherein the first and second elastic elements are each connected to an arm.

Such a feature has the advantage of making it possible to obtain a greater pivoting angle than if the two elastic elements were connected on the same side as is the case in the European patent application cited in the introduction.

3. —The immobilizing device for a toothed wheel according to point 1 or 2, wherein the third elastic element is connected to one of the arms in a location different from the junction zone of these arms.

Advantageously this makes it possible to ensure that one of the first and second elastic elements works in tension and the other in compression, which is impossible with the lever forming the subject of the aforementioned patent application. Moreover, the adjustment of the stresses by the third element is made easier because it is not hampered by the first and second elastic elements as is the case with the abovementioned lever.

4. —The immobilizing device for a toothed wheel according to point 3, wherein the third elastic element is connected to the end of one of the arms.

Thus, the possibilities of adjustment of the tension and/or compression of the first and second elastic elements are maximized.

5. —The immobilizing device for a toothed wheel according to one of points 1 to 4, wherein the first and second elastic elements form an obtuse angle between them.

6. —The immobilizing device for a toothed wheel according to one of points 1 to 5, wherein the first and second elastic elements are first and second flexible strips.

7. —The immobilizing device for a toothed wheel according to one of points 1 to 6, wherein the third elastic element is a rigid block comprising, on two opposite sides, a third and a fourth flexible strip.

8—The immobilizing device for a toothed wheel according to one of points 1 to 7, wherein the third elastic element is also connected to the frame.

9—The immobilizing device for a toothed wheel according to point 7, wherein the fourth flexible strip is connected to an additional block, the latter being if necessary connected to the frame.

10—The immobilizing device for a toothed wheel according to one of points 1 to 9, also comprising a prestress system applying a force to the third elastic element.

11. —The immobilizing device for a toothed wheel according to point 10, wherein the prestress system is capable of causing the force applied to the third elastic element to vary.

12. —The immobilizing device for a toothed wheel according to point 11, wherein the variable prestress system comprises an eccentric screw or a micrometric screw.

13. —The immobilizing device for a toothed wheel according to point 11, wherein the variable prestress system comprises an additional block connected to the frame by fifth and sixth flexible strips or by means of an intermediate block itself connected to the frame by seventh and eighth strips.

14. —The immobilizing device for a toothed wheel according to point 13, wherein the seventh and eighth strips are placed such that, during a movement of the four strips, their reductions in length cancel one another out, so as to prevent any untoward movement of the block when the prestress is adjusted.

15. —The immobilizing device for a toothed wheel according to point 13 or 14, wherein the intermediate block comprises a post and the frame comprises a recess capable of accommodating the post and of delimiting its movements.

It goes without saying that it is possible to combine together at least two of these points unless it is technically impossible.

Moreover, the invention also relates to a timepiece summarized in the following point:

16. —A timepiece comprising an immobilizing device for a toothed wheel according to one of points 1 to 15.

Point 17 below provides additional advantageous features of the timepiece according to the invention:

17. —The timepiece according to point 16, the immobilizing device forming part of an escapement and the toothed wheel being an escapement wheel.

According to another aspect, the invention also relates to methods for producing a timepiece the essential features of which emerge from the following points:

18. —A method for assembling a timepiece comprising the following steps:

- an immobilizing device according to point 12 is attached to the main plate; and
- the eccentric screw is rotated until a bistable system is obtained.

19. —A method for assembling a timepiece comprising the following steps:

- an immobilizing device according to point 13 or 14 is attached to the main plate of the movement;
- a micrometric or eccentric screw is attached so that it is in contact with the additional block; and
- the first micrometric or eccentric screw is turned until a bistable system is obtained.

20. —A method for assembling a timepiece comprising the following steps:

- an immobilizing device according to one of points 13 to 15 is attached to the main plate of the movement;
- a micrometric screw is attached so that it is in contact with the intermediate block; and
- the micrometric screw is turned until a bistable system is obtained.

21. —The method for assembling a timepiece according to point 20, also comprising the following step:

- before turning the micrometric screw to obtain the bistable system, a wedge is inserted between the frame and the intermediate block.

Figure 1:
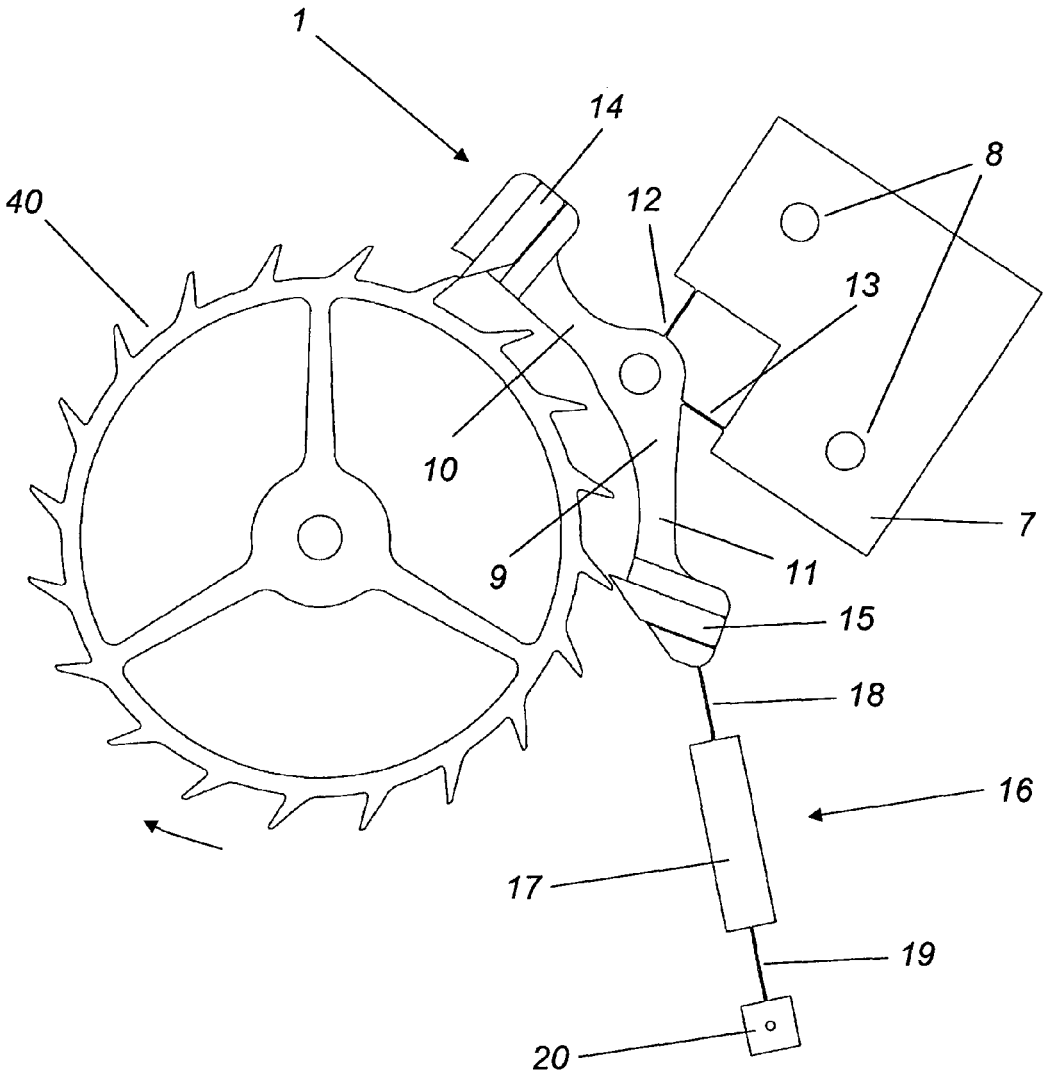
Figure 2:
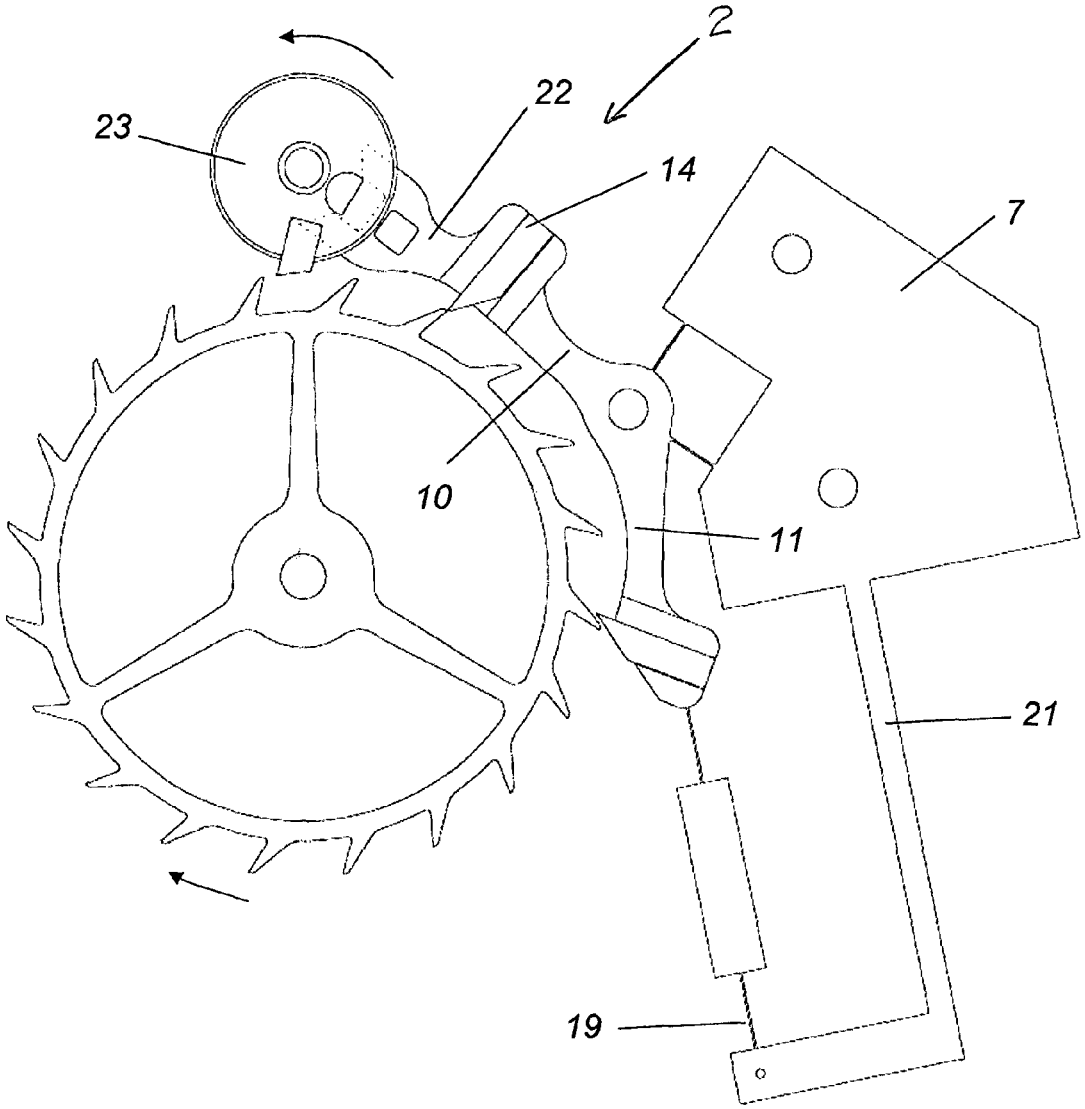
Figure 3:
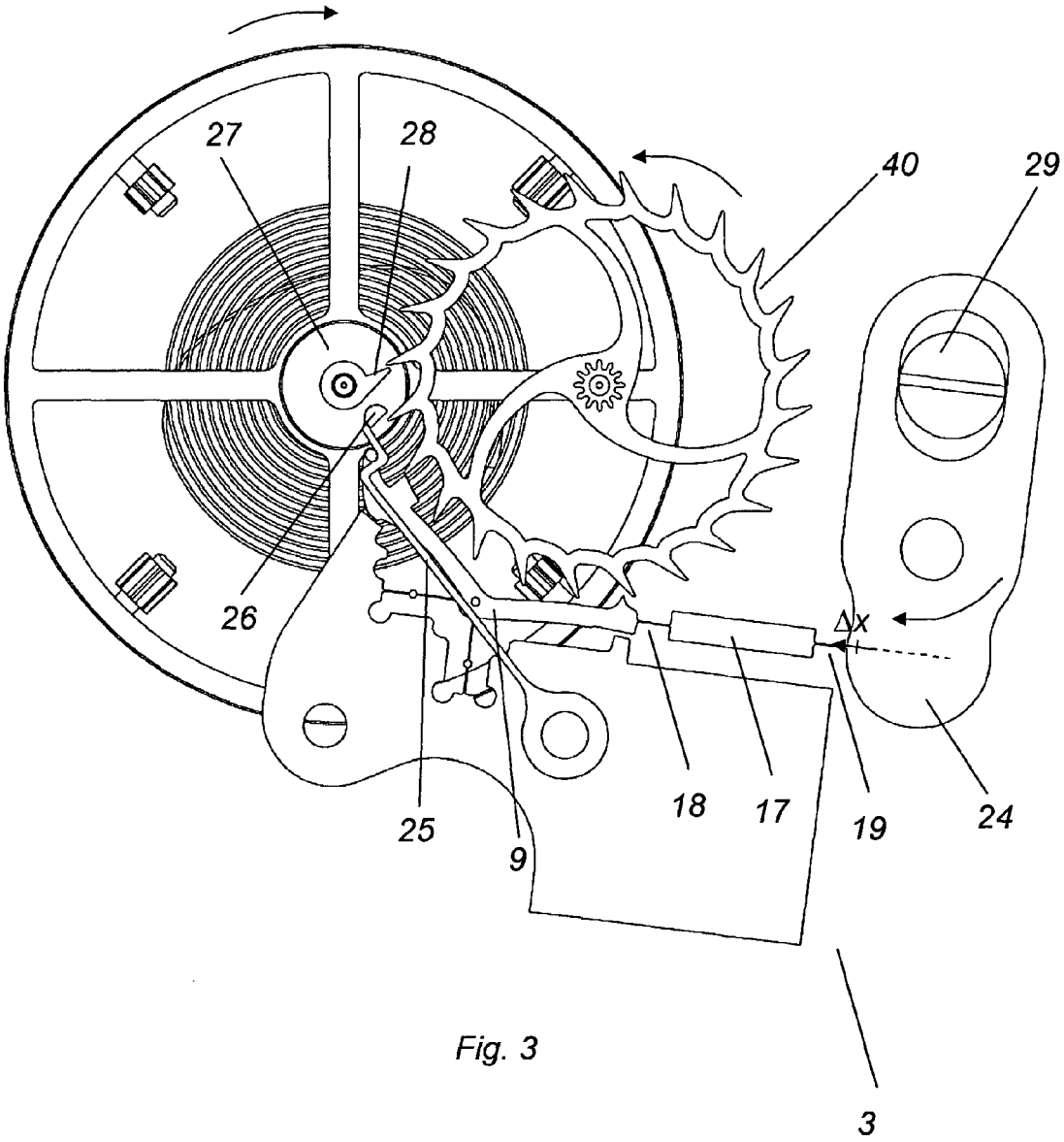
Figure 4:
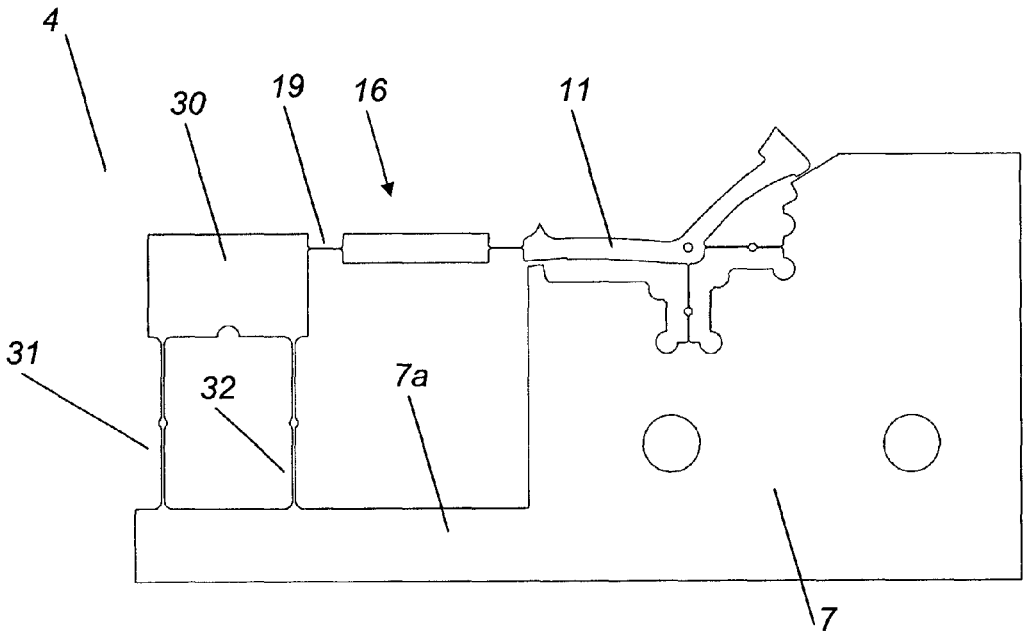
Figure 5:
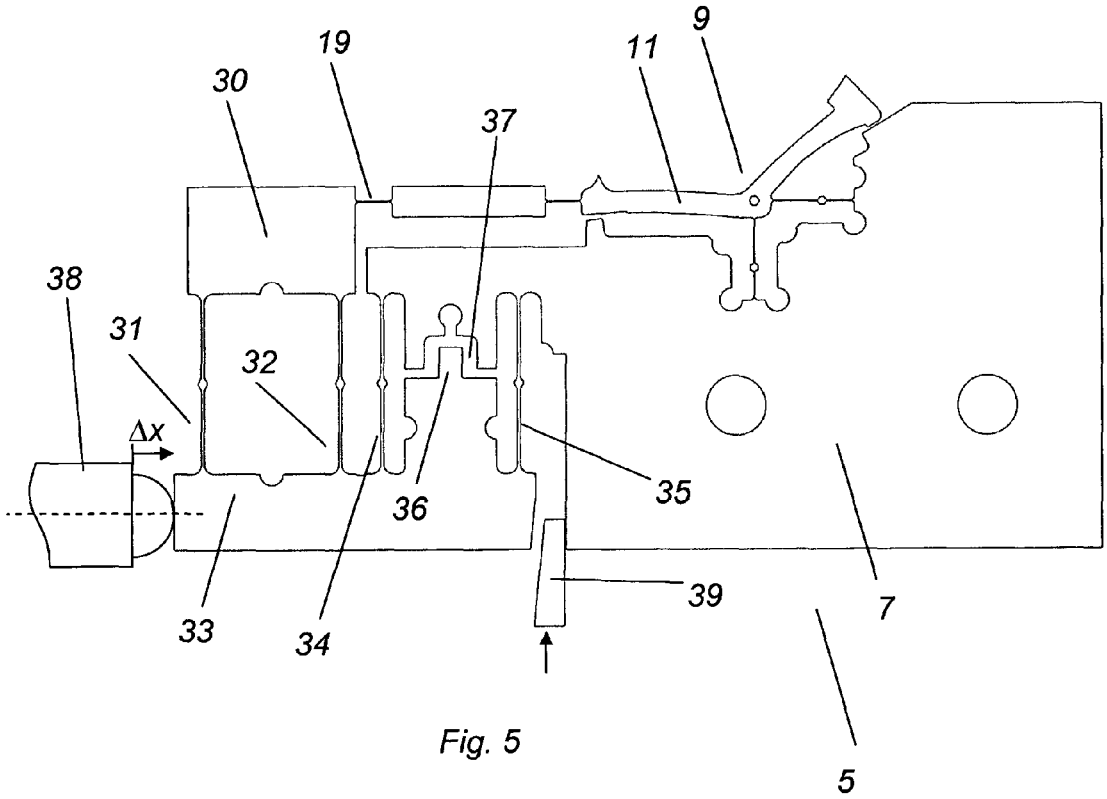
Figure 6:
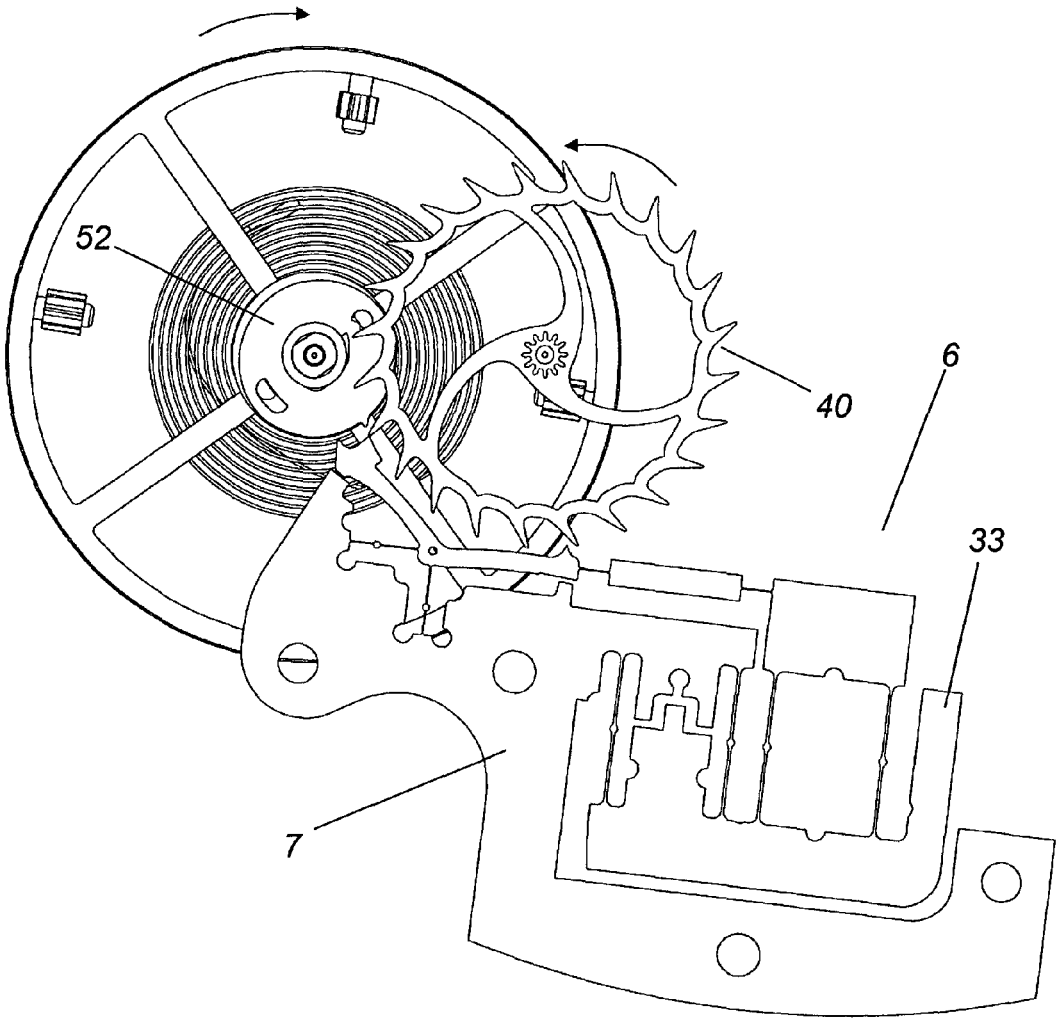
Figure 9:
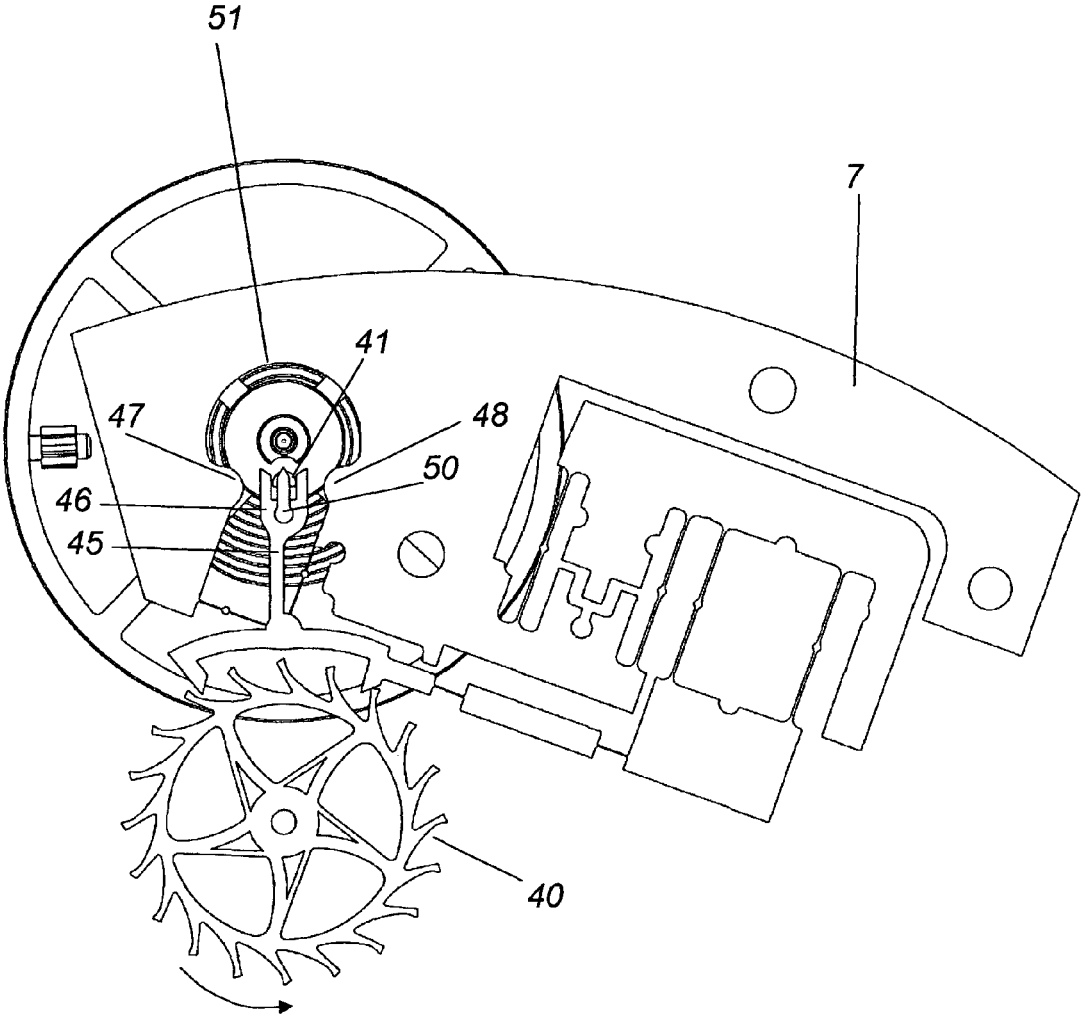
Figure 10:
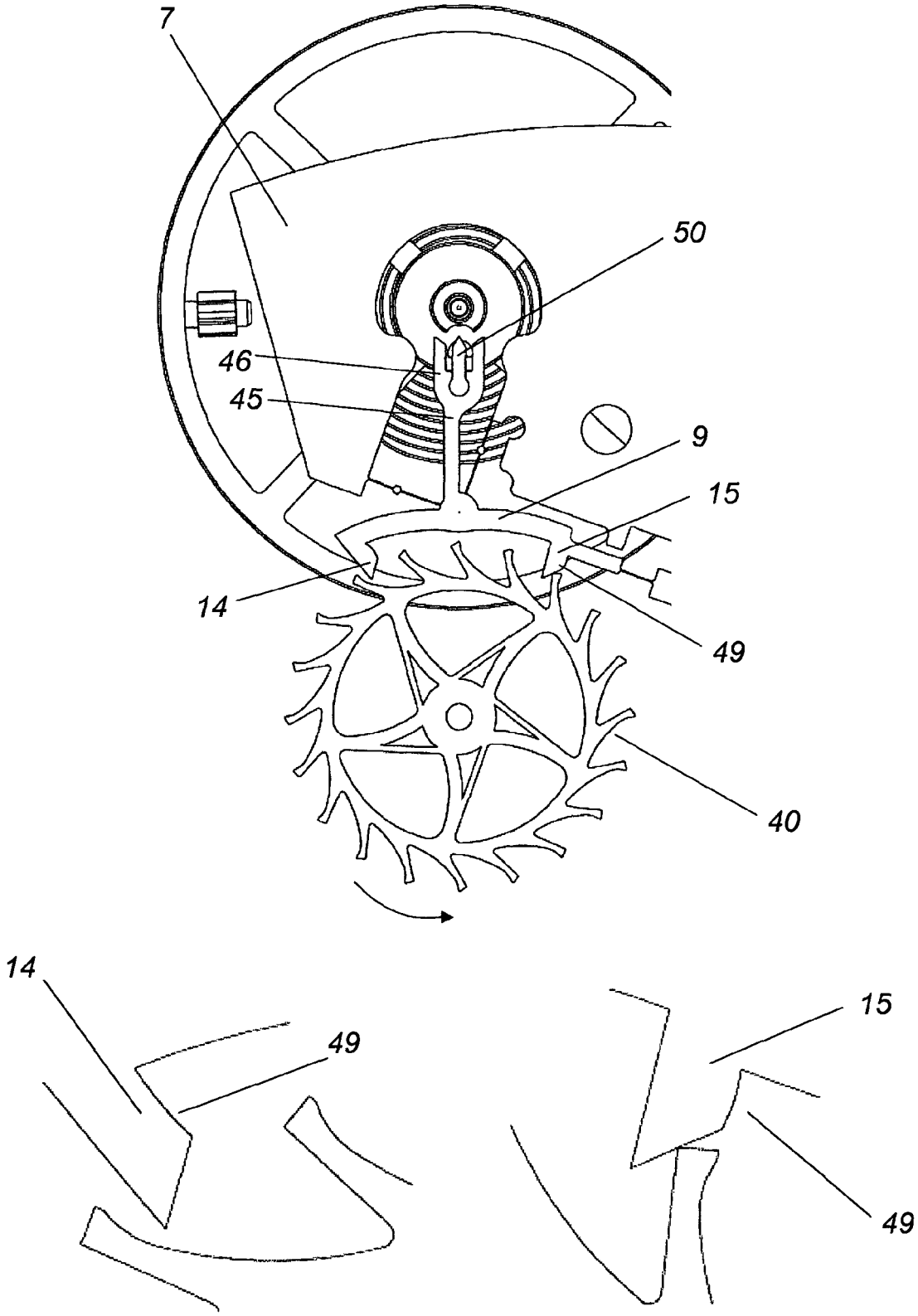
Figure 11:
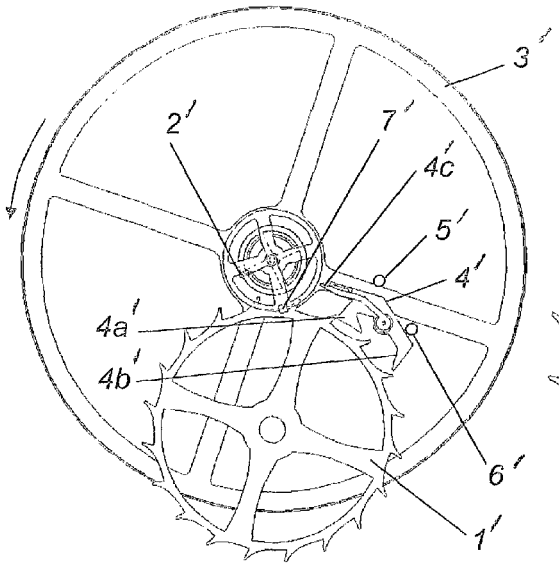

Other features and advantages of the invention will now be described in detail in the following explanation which is given with reference to the appended figures which represents schematically:

FIG. 1: an immobilizing device according to the invention;

FIG. 2: an immobilizing device according to the invention applied to an escapement of the Robin type;

FIG. 3: an advantageous embodiment of the immobilizing device according to the invention applied to an escapement of the detent type with eccentric screw;

FIG. 4: another advantageous embodiment of the immobilizing device according to the invention applied to an escapement of the detent type;

FIG. 5: an embodiment of the immobilizing device according to the invention, which is an improvement on that of FIG. 4;

FIG. 6: the application of the embodiment of FIG. 5 to an escapement of the detent type with inertial plate;

FIG. 7: the application of the embodiment of FIG. 5 to a conventional detent escapement;

FIG. 8: the application of the embodiment of FIG. 5 to an escapement of the Robin type with a lever;

FIG. 9: the application of the embodiment of FIG. 5 to an indirect impulse escapement of the conventional Swiss lever type;

FIG. 10: an enlargement of a portion of FIG. 9;

FIG. 11 is a plan view of a portion of an escapement similar to the escapement shown in FIG. 3, without the flexible elements and the frame; and FIGS. 12 to 21 represent the escapement of FIG. 11 on a larger scale, without the balance wheel, in various positions during an oscillation cycle.

DETAILED DESCRIPTION OF THE INVENTION

Immobilizing Device According to the Invention

This immobilizing device is shown in general in FIG. 1 in which it is placed beside a toothed wheel with which it is designed to interact.

As can be seen in the figure, the immobilizing device 1 comprises an immobilizer 9 comprising two arms 10, 11 forming between them an elbow and an angle (obtuse in the figure but could be acute) on the side opposite the elbow, that is to say on the side of the toothed wheel 40.

On the side opposite to the toothed wheel 40, from points situated close to the elbow and to the junction zone of the arms 10, 11 there extend flexible strips 12, 13, one per arm 10, 11, which form an angle between them, for example of 90 degrees.

Preferably, the immobilizing device according to the invention comprises a frame 7 designed to be attached in a known manner to a support such as a main plate or a clockwork movement bridge, for example by means of holes 8 provided to receive attachment screws. The flexible strips 12, 13 then join this frame 7.

Naturally, the flexible strips 12, 13 could optionally depart from one and the same arm, provided that their virtual intersection, which defines the pivoting point of the immobilizer, is produced in the appropriate location for the correct operation of the escapement. However, placing one end of the flexible strips each on one arm makes it possible to maximize the pivoting angle of the device.

One of the arms, the arm 10, is furnished at its free end, or close to the latter, with an input pallet 14 designed to immobilize a tooth of the toothed wheel 40.

The other arm 11 is provided, at its end that is not the one connected to the arm 10, or close to the latter, with an output pallet 15 designed to come into contact with a tooth of the toothed wheel 40.

Geometric Prestress

According to one feature of the invention, an elastic element 16 is connected to the immobilizer, preferably to the end of one of the arms, for example to the end of the arm 11. This elastic element 16 consists of a rectangular rigid block 17 which is extended, on its transverse side turned toward the arm 11, by a flexible strip 18 and, on its other transverse side, by a flexible strip 19.

This flexible strip 19 can be connected to an attachment block 20.

However, the flexible strip 19 is preferably connected to the frame 7. Thus, in FIG. 2, the flexible strip 19 is connected to an L-shaped portion 21 which joins the frame 7.

The elastic element 16 is essential to the correct operation of the immobilizing device according to the invention. Specifically, it makes it possible to produce a pivoting system with three articulations, namely:

- a first articulation on the frame by means of the flexible strips 12, 13;
- a second articulation between the arm 11 and the elastic element 16 by means of the flexible strip 18; and
- a third articulation between the elastic element 16 and the block 20 (FIG. 1) or the L-shaped portion 21 (FIG. 2), by means of the flexible strip 19.

Such a pivoting system with three articulations is also called a "toggle joint".

The dimensioning of the frame (21), or fine adjustment of the distance between the block 20 and the frame 7, makes it possible to give a bistable behavior to the mechanism, that is to say that the pivoting system with three articulations allows the immobilizer 9 to move between two well-defined positions of stable equilibrium while passing through a position of unstable equilibrium.

The prestress can be obtained by an appropriate dimensioning of the portions of the immobilizing device. It can be planned at the design stage of the immobilizing device. Therefore, in FIG. 2, if the L-shaped portion 21 presses against the strip 19, it indirectly applies a prestress to the arm 11.

In FIG. 1, the block 20 can be attached close to the rigid block 17, at a distance that is less than the length of the strip 19, so as to press against the strip 19.

FIG. 2 represents an immobilizing device 2 according to the invention as applied to an escapement of the Robin type. As can be seen, the end of the arm 10 that is opposite to the arm 11 is extended, beyond the input pallet 14, by a fork-shape portion 22 provided to interact with a balance wheel only the roller 23 of which is shown in FIG. 2.

This fork-shaped portion 22 and its interaction with the balance wheel are well known to those skilled in the art. The latter will be able to find in reference works dealing with escapements of the Robin type, or if necessary in European patent application No. EP-A-1 122 617, all the details concerning the precise shape of the portion 22 and its interaction with the balance wheel.

FIG. 3 represents the immobilizing device according to the invention as applied to an escapement of the detent type. Consequently, a detent 25, which is connected in a known manner to the immobilizer 9, interacts with an unlocking pin 26 attached to the roller 27 of a balance wheel shown in the figure. Similarly, an impulse pallet 28 is provided on a portion secured to the balance wheel in order to be driven by the escapement wheel 40. All this is well known to those skilled in the art who will be able to find, in reference works dealing with escapements of the detent type, or optionally in European patent application No. EP-A-1 708 046, all the details concerning the immobilizer, the attachment and the precise shape of the detent 25 and its interaction with the balance wheel.

By virtue of the frame 7, the immobilizing device according to the invention can be easily installed. Specifically, the pivoting by the flexible strips and above all the bistable behavior of the system, requires a good control of the dimensions and of the positioning of the various elements. The solution described in application EP 2 037 335 is very problematic from this point of view, because the elastic elements are each secured separately to the clockwork movement. If the immobilizer 9, the elastic elements 12, 13, 16, and, if necessary, other elements of the device, depending on the chosen embodiments, are made all in a single block with the frame 7, it is the latter that is secured to the movement during the assembly and the relative positioning of the various elements is not modified by the assembly of the immobilizing device in the clockwork movement.

Elastic Prestress

According to one advantageous embodiment of the invention, the operation of the three-articulation system is improved by virtue of a prestress system acting on the elastic element 16.

This elastic prestress system allows better control of the prestress force than with the geometric prestress method. This makes it possible to reduce this sensitivity of the bistable behavior to dimensional errors of the constituent parts of the immobilizing device according to the invention and therefore makes it possible to increase the dimensional tolerances.

This prestress system constantly applies an elastic force to the elastic element 16 by means of the prestressed strips 31 and 32 (FIG. 4).

Adjustable Geometric Prestress

Preferably, the prestress system is adjustable, that is to say that it is capable of varying the stress applied to the elastic element 16.

This can be obtained by means of an eccentric screw. Therefore, as can be seen in FIG. 3, a variable prestress system is achieved with the aid of an eccentric screw 29. When the latter is turned, it rotates the additional block 24. The latter then presses more or less, depending on the direction of rotation of the eccentric screw 29, on the strip 19, which pushes the rigid block 17, the strip 18 and then the arm 11 of the immobilizer 9.

Adjustable Elastic Prestress

FIG. 4 shows another way of producing an adjustable elastic prestress system. It consists in connecting the strip 19 of the elastic element 16 to an additional block 30 which is itself connected to the frame 7 by means of flexible strips 31, 32 which play a guiding role. By subsequently moving, for example by means of a screw (not shown), the additional block 30, the prestress exerted on the elastic element 16 is applied and made to vary. It is therefore possible to increase this prestress by an appropriate dimensioning of the portion 7*a* of the frame 7 to which the flexible strips 31, 32 are connected.

FIG. 5 shows an advantageous variant of the embodiment shown in FIG. 4. In this variant, the additional block 30 is not connected to the frame 7 directly, but by means of an intermediate block 33 which is itself connected to the frame 7 by flexible strips 34, 35 which play a guiding role.

Therefore, when a movement $\Delta x$ is applied to the intermediate block 33, the strips 31, 32, 34 and 35 bend in an identical manner and the intermediate block 33 tends to be moved upward at the same time as from left to right (in FIG. 5) because of the relative shortening of these four strips. This system therefore acts like a preload spring consisting of the strips 31 and 32 working in parallel and whose prestress travel is x. The reductions in length of the strips 31, 32 and 34, 35 are compensated such that the block 30 sustains no downward movement. This has the advantage that the adjustment of the prestress (irrespective of the distance Δx) in no way changes the geometry of the toggle joint (alignment of the articulations of the parts 19 and 11, FIG. 5) and hence the conditions of its stability.

Prestress by an Outside Force

As a variant, it is possible to use an external prestress acting as an additional spring applying a force F to the block 30 of FIGS. 4 and 5. The strips 31 and 32 then do not play a guiding role, whereas they previously played both a guiding role and the role of a spring.

In FIG. 4, the force F (not shown) is then applied directly to the block 30 in the direction of the elastic element 16.

In FIG. 5, the force F (not shown) is applied to the block 33, in the direction of the movement Δx shown in this figure, and the prestress is transmitted to the elastic element 16 by means of the strips 31 and 32.

Advantages of the Prestress System

Therefore, by virtue of the geometric or elastic prestress system, whether it be variable or fixed, the immobilizer 9 adopts a bistable behavior, that is to say that it can no longer oscillate freely about a single central position of equilibrium, but tilts from one stable extreme position to another. This therefore gives increased security: during the unlocking phase before impulse, the pulling torque due to the bistable flexible pivot formed by the elastic strips 12, 13 is added to the pulling force of the escapement wheel 40. This pulling torque determines the dynamic behavior of the flexible pivot. If this system is compared to a conventional detent escapement, it can be seen that the return torque of the bistable flexible pivot replaces the return torque of the spring of the conventional detent escapement.

This provides a major advantage: a portion of the energy normally necessary for the unlocking of an immobilizer is recovered because the real driving angle of the balance wheel (the angle traveled between the moment when the balance wheel comes into contact with the fork or the finger releasing the lever and the moment when the immobilizer releases the escapement wheel) is reduced by virtue of the bistability which naturally causes the immobilizer 9 to tilt into its second stable position, thus reducing the time of contact with the balance wheel.

Other advantages arise from the fixed or variable prestress system:

- better precision due to the removal of the pivoting between a staff and bearings and therefore the removal of the pivoting clearances, which greatly helps the practical production of an escapement the lever of which exhibits a very small angle of tilt, like the Robin escapement (3 degrees against 15 degrees for a standard Swiss lever escapement);
- the precision of the pivoting is also increased;
- the bistability makes it possible to remove a security element; it is thus possible, in the case of the Robin escapement and of the Swiss lever, to forego furnishing the lever with a guard pin (anti-reversal system); in the case of the Robin escapement, with detent or with Swiss lever, it is also possible to remove the recoil of the wheel tooth on the pallet and the backward movement of the wheel during the disengagement, for example with pallets with rounded edges; the pulling is then replaced by the potential well of the immobilizer to be overcome, which prevents the geometric backward movement and the dynamic backward movement and makes it possible to recover a portion of the energy used to tilt the immobilizer.

Preferably, as can be seen in FIG. 5, the intermediate block 33 comprises a post 36 and the frame 7 comprises a recess 37 capable of receiving this post and of delimiting its movements. The post 36 therefore plays the role of a limitation abutment, in order to protect the system and prevent accidental breakages during the application of the prestress. Specifically, the movement of the post 36 is limited by the walls of the recess 37. Its maximum movement is designed to remain less than the movement corresponding to the breaking stress.

FIG. 6 represents the use of the immobilizing device that has just been described in an escapement of the detent type. Only the shape of the frame 7 differs here from that of the frame of FIG. 5.

In FIG. 6 it can be seen that the balance wheel is surmounted by an inertia plate 52. The latter and its operation are described in detail in the European patent application published under No. EP 2 221 677 the content of which is incorporated by reference in the present patent application. In this application, EP 2 221 677, the inertia plate 52 is called the "inertial member 11".

The immobilizing device according to the invention also comprises several advantages over the known systems of the prior art, notably European patent application No. EP 2 037 335 A2 which relates to a lever for a watch escapement.

In the aforementioned application, FIGS. 7 and 8 show that the first two elements forming the pivot are placed on the same side of the immobilizer and have between them an angle of markedly less than 90° (30° in the case of FIG. 7), with the third element placed on the bisecting line and inside the angle formed by the first two elements (see paragraph 22, 1. 43-48).

This arrangement can make it possible to obtain a bistable behavior but has considerable disadvantages. On the one hand, the two elastic elements work by buckling when the system is in a bistable mode. The buckling is difficult to control in practice because the critical load to be applied to each element in order to make it buckle is $8\pi*E*I/l^2$, where E is the Young's modulus of the material, l is the length of the element and I is its inertia (which is proportional, in the case of rectangular strips, to the height h and the thickness e cubed, $I=h*e^3/12$). It can be seen that this critical load is very sensitive to the dimensions of the strip and in particular to its thickness. The slightest manufacturing imperfection can therefore cause the load necessary to obtain the bistable behavior to vary greatly.

Furthermore, the angle between the first two elements that form the pivot is much less than 90°, which makes the system sensitive to imperfections. The force that has to be applied to the third element to make the system bistable will be largely transferred to the strips: the component of the force along the strips will not in all cases be less than 70.7% ($\cos(\theta/2)$ where $\theta=90°$) of the force applied to the third elastic element. In the case of FIG. 7 of the aforementioned application, it will be 96%.

Finally, the elastic energy is wholly stored in the two pivoting elements by buckling of the strips.

In the immobilizing device according to the invention, the angle between the first two elements that form the pivot is usually 90° and may even be higher. For its part, the force is preferably applied in a direction that is outside the sector formed by the two pivoting elements which means that only one strip is acted upon in compression and therefore by buckling, the other strip being acted upon in tension. The influence of the variation in dimensions on the critical load is therefore markedly reduced which means that the manufacturing tolerances are much less critical to the operation of the system. The distribution between the compression (buckling) and tension stresses can also be adjusted with the angle between the first two elastic elements and with the orientation of the force F relative to the first two elastic elements. Finally, the elastic energy is largely stored in the third elastic element.

The immobilizing device according to the invention therefore advantageously provides the possibility of ensuring that one of the first and second elastic elements works in tension and the other in compression which is impossible with the lever forming the subject of the aforementioned patent application. Moreover, the adjustment of the stresses by the third element is made easier because it is not hampered by the first and second elastic elements as is the case with the abovementioned lever.

The immobilizing device according to the invention extends in a single plane and can be made all in one block, for example in silicon by using the DRIE ("Deep Reaction Ion Etching") method, or in Ni or NiP by using the UV-LiGA ("Lithography, electroplating, and molding"). These two methods make it possible to manufacture the immobilizing device according to the invention while complying with the required strict tolerances.

It is also possible and just as advantageous to make use of the same methods to produce parts comprising several levels.

As a variant, it is possible to produce the immobilizing device according to the invention in two or three parts, that is to say by providing for one and/or the other of the pallets to be mounted on the immobilizer. It is then possible to use pallets made of ruby in order to allow a fine adjustment of the penetrations.

Use of the Immobilizing Device According to the Invention

The immobilizing device for a toothed wheel according to the invention applies to many mechanisms, in particular to the direct impulse escapement mechanisms such as Robin-type or detent escapements in a clockwork part, notably in a wristwatch.

"Direct-impulse escapement" means that the impulse of the toothed wheel is directly communicated to the balance wheel.

Therefore, FIG. 7 shows a conventional detent escapement in which the inertia plate 52 of FIG. 6 has been replaced by a pin 41 that interacts with the detent strip 42. This strip 42 bends when the pin 41 comes into contact with it and drives the immobilizer 9 in the direction G via a tenon 43, while the pin retracts in the direction H.

FIG. 8 shows an escapement of the Robin type in which the pin 41 secured to the balance wheel interacts with a fork 44 extending the end of the arm 10 of the immobilizer 9 in order to disengage the latter and release the toothed wheel 4. The latter is disengaged on each alternation but transmits an impulse only on one alternation out of two, it is therefore a single-beat escapement.

Measurements have shown that the average output of the immobilizing device according to the invention, as shown in FIG. 6, is very good and notably makes it possible to produce a functional detent escapement for a wristwatch with security elements suitable for a reliable operation despite the impacts normally sustained by a wristwatch.

The immobilizing device according to the invention applies also to indirect-impulse escapements such as the Swiss lever escapement.

"Indirect-impulse escapement" means that the impulse is transmitted indirectly from the toothed wheel to the balance wheel.

Thus, FIG. 9 shows a conventional Swiss lever escapement in which the impulse is transmitted from the toothed wheel 40 to the balance wheel by means of a lever 45 and a fork 46. As can be seen in this figure, the frame 7 advantageously makes it possible to directly incorporate the abutments 47, 48 for limiting the movement of the lever 45, which are also called bankings. The frame 7 is furnished with an opening 51 allowing the rotation of the pin 41 supported by the roller secured to the balance wheel and the movement of the fork 46.

The increased precision of the pivoting provided by the invention has the advantage of making it possible to delete a security element. Because of this, in a Swiss lever escapement like that shown in FIG. 9 (as in the case of an escapement of the Robin type), it is possible to dispense with furnishing the lever 45 of the guard pin 50 because the system prevents reversals of the lever, for example following an impact. It is also or alternatively possible to remove the pulling of the teeth of the toothed wheel 40 on the input pallet 14 and output pallet 15, and therefore the recoil of this toothed wheel during the disengagement, by using for example an input pallet 14 and an output pallet 15 the rest plane 49 of which is rounded instead of being rectilinear, as can be seen in FIG. 10. Because of this, the pulling is replaced by the potential well of the immobilizer to be overcome, which prevents geometric recoil and dynamic recoil and makes it possible to recover a portion of the energy used to cause the immobilizer 9 to tilt. This solution is illustrated in FIG. 10 for a Swiss lever escapement, but may also be applied to a detent or Robin escapement.

Method for Producing a Timepiece

With the embodiments of FIGS. 3 to 10, the angular rigidity of the immobilizer 9 can be modified and adjusted until a bistable operation mode is achieved. The potential energy of the system then has two potential wells clearly defined about a maximum and allowing a very precise pivoting of the immobilizer from one position to the other.

Thus, during the manufacture of a timepiece, it is advantageous to use, in addition to the conventional steps that are well known to those skilled in the art, steps specific to the immobilizing device according to the invention.

Consequently, if use is made of the immobilizing device with variable prestress system 3 that can be seen in FIG. 3, after the immobilizing device has been attached to the plate of the movement of the timepiece, the eccentric screw 29 is turned until a bistable system is obtained.

If the immobilizing device with adjustable prestress system 4 is used that can be seen in FIG. 4, after the immobilizing device has been attached to the plate of the movement of the timepiece, a micrometric or eccentric screw is attached to the plate so that it is in contact with the additional block 30, then it is turned in an appropriate manner to obtain a bistable system.

If the immobilizing device with adjustable prestress system 5 or 6 is used, that is seen in FIG. 5 or 6 respectively, after the immobilizing device has been attached to the plate of the movement of the timepiece, a micrometric or eccentric screw 38 is attached to the plate so that it is in contact with the intermediate block 33, then it is turned in an appropriate manner until a bistable system is obtained. To further increase the precision of positioning, it is possible to insert, before turning the screw 38 to make the adjustment, a quoin-shaped wedge 39 between the frame 7 and the intermediate block 33. The wedge 39 then serves as an adjustable abutment the gearing factor of which allows a fine adjustment of movement.

Application to a Detent Escapement with Sliding Pallet

Returning to FIGS. 3, 9 and 10, it is found that the escapement that is shown therein is a little peculiar. This escapement will now be described in detail with reference to FIGS. 11 to 21 in which, for the purposes of simplification, neither the elastic strips nor the additional and intermediate rigid attachment blocks nor the frame is shown.

This is a detent escapement for a clockwork movement that is summarized as follows:

a. Detent escapement for a clockwork movement, comprising a balance wheel 3' secured to an impulse element 2', an escapement wheel 1' of which the gear teeth cut the trajectory of the impulse element 2', a detent rocker 4' having a stop element 4*a*' and an elastic disengagement element 4*c*', means for engaging the stop element in the trajectory of the gear teeth of the escapement wheel 1' and a disengagement finger 7' secured in rotation to the balance wheel 3' in order to engage with the elastic disengagement element 4*c*' of the rocker 4' once per oscillation period of the balance wheel in order to disengage the stop element 4*a*' from the gear teeth of the escapement wheel, this escapement having this particular feature whereby said means for engaging the stop element 4*a*' in the trajectory of the gear teeth of the escapement wheel 1' comprise a sliding surface 4*b*' secured to the detent rocker 4', placed so as to penetrate the trajectory of the gear teeth of the escapement wheel 1' when the stop element 4*a*' comes out therefrom, this sliding surface being formed so that the force exerted on it by a tooth of the escapement wheel 1' causes the stop element 4*a*' of the detent rocker 4' to return to the trajectory of the gear teeth of the escapement wheel 1'.

Advantageous features of this escapement are indicated in points b and c below:

b. Escapement according to point a, wherein the stop element 4*a*' of the detent rocker comprises a security surface 4*e*' situated outside the trajectory of the teeth of the escapement wheel 1' and adjacent to this trajectory in the unlocked position of the detent rocker 4'.

c. Escapement according to point b, wherein the length of the security surface 4*e*' corresponds to the angle through which the escapement wheel 1' travels in order to communicate the driving impulse to the balance wheel 3' in order to prevent the premature return of the stop element 4*a*' into the trajectory of the teeth of the escapement wheel 1'.

The main advantage of such an escapement is to increase the security against impacts. Another advantage lies in the fact that the stop element of the detent rocker is not returned to the trajectory of the teeth of the escapement wheel by a spring primed by the balance wheel, but by the sliding surface against which a tooth of the escapement wheel acts in order to move the rocker to the locked position of the escapement wheel. The energy consumed is less and it is not supplied by the balance wheel, but by the escapement wheel, reducing to the minimum the disruption of the oscillation period of the balance-hairspring oscillator. Moreover, this detent rocker with a stop element and a sliding surface that alternately penetrate the trajectory of the gear teeth of the escapement wheel constitutes additional security.

Advantageously, the stop element of the detent rocker comprises a security surface situated outside the trajectory of the teeth of the escapement wheel and adjacent to this trajectory in the unlocked position of the detent rocker. The length of this security surface corresponds to the angle that the escapement wheel travels to communicate the driving impulse to the balance wheel, in order to prevent the premature return of the stop element to the trajectory of the teeth of the escapement wheel. This is therefore again a second additional security.

More precisely, the escapement illustrated by FIG. 11 comprises an escapement wheel 1' in which the circular trajectory of the teeth cuts the trajectory of an impulse pallet 2' secured to the balance wheel 3' associated with a hairspring (not shown).

A detent rocker 4' can be moved freely between two abutments 5', 6'. On the one hand it comprises a stop element of which one abutment face 4*a*' serves to stop a tooth of the escapement wheel 1' and on the other hand a sliding surface 4*b*' to allow a tooth of the escapement wheel to slide over this surface 4*b*' and to cause the rocker to rock counterclockwise in order to return the abutment face to the trajectory of the teeth of the escapement wheel 1'. This detent rocker 4' also comprises an elastic disengagement element 4*c*' resting against an abutment 4*d* and of which the free end enters the trajectory of a disengagement finger 7' secured to the balance wheel 3'.

The stop element of the detent rocker 4' also has a security surface 4*e*' that is situated outside the trajectory of the teeth of the escapement wheel 1' and adjacent to this trajectory when the detent rocker 4' rests against the abutment 5' (FIGS. 13 to 16). This surface extends over an angle of the escapement wheel 1' corresponding to the angle during which a tooth of the escapement wheel communicates its impulse to the impulse pallet 2' of the balance wheel 3'.

An oscillation cycle of the balance-hairspring 3' is divided into the various phases illustrated by FIGS. 11 to 21.

In the phase illustrated by FIG. 11, the balance wheel 3' turns counterclockwise. The abutment face 4*a*' of the stop element of the rocker 4' retains the escapement wheel 1' which holds the rocker 4' against the abutment 6'.

Figure 12:
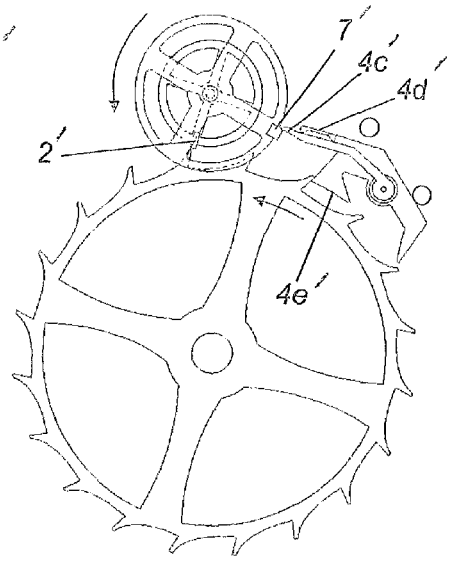
Figure 13:
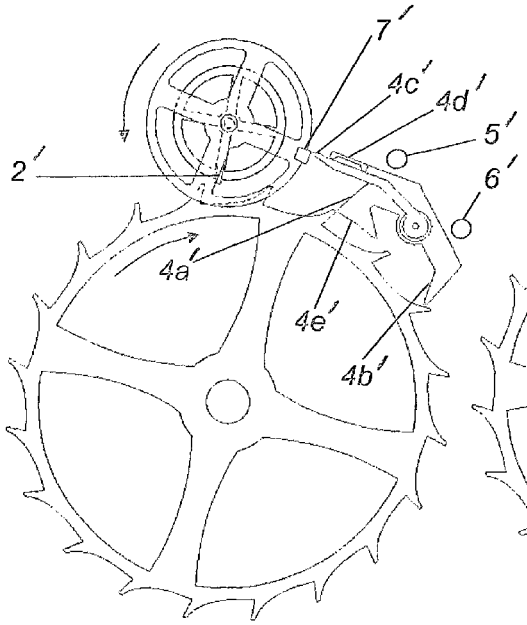

The phase illustrated by FIG. 12 corresponds to the moment in which the disengagement finger 7' secured to the balance wheel 3' encounters the elastic disengagement element 4*c*' resting against the abutment 4*d*'. Because of the abutment 4*d*' and the counterclockwise direction of rotation of the balance wheel 3', the elastic disengagement element 4*c*' behaves like a rigid element.

The detent rocker 4' then, under the action of the disengagement finger 7' travels from resting against the abutment 6' to resting against the abutment 5' (FIG. 13), thus releasing the escapement wheel 1' of which a tooth was stopped by the abutment face 4*a*' of the stop element of the detent rocker 4'.

Figure 14:
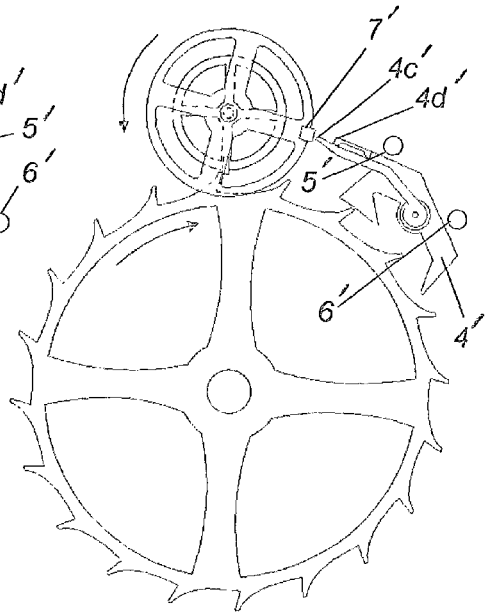

Since the escapement wheel 1' is subjected to the torque of the barrel spring (not shown) transmitted by the watchwork gear train (not shown), it is then driven in the clockwise direction. One of its teeth then encounters the impulse pallet 2' of the balance wheel 3' (FIG. 14). It is the beginning of the impulse phase during which the energy of the barrel spring is transmitted to the balance wheel 3' in order to transmit thereto the energy necessary for the maintenance of its oscillating movement.

Figure 15:
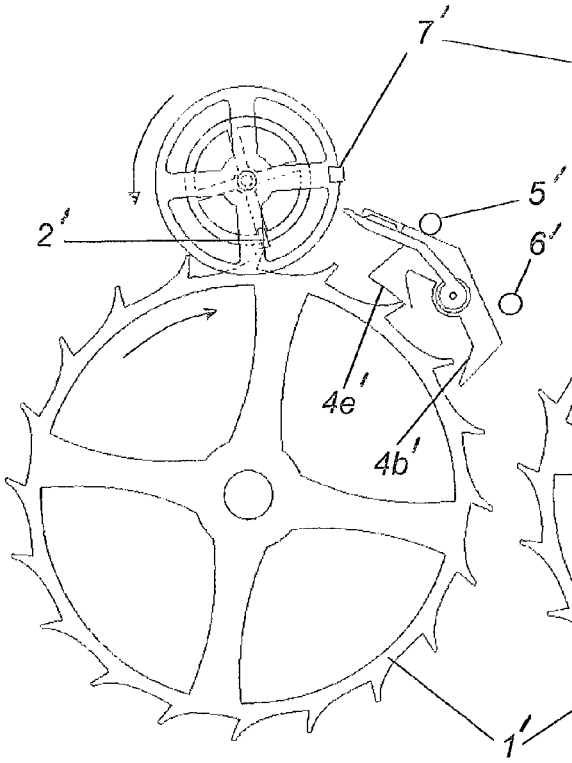

This impulse phase ends when the tooth of the escapement wheel leaves the impulse pallet, that is to say practically in the position illustrated by FIG. 15. As can be seen, during the whole of this impulse phase, the security surface 4*e*' of the stop element of the detent rocker 4' prevents the stop element from entering the trajectory of the teeth of the escapement wheel 1' following an impact for example.

Figure 16:
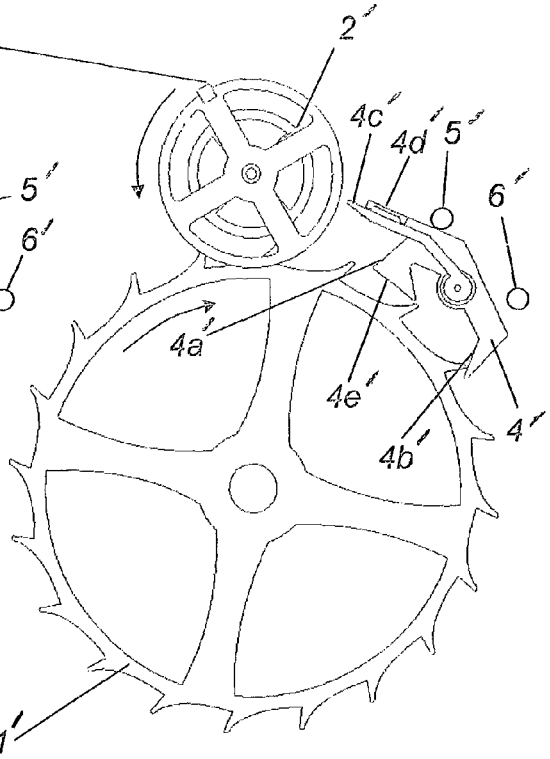
Figure 17:
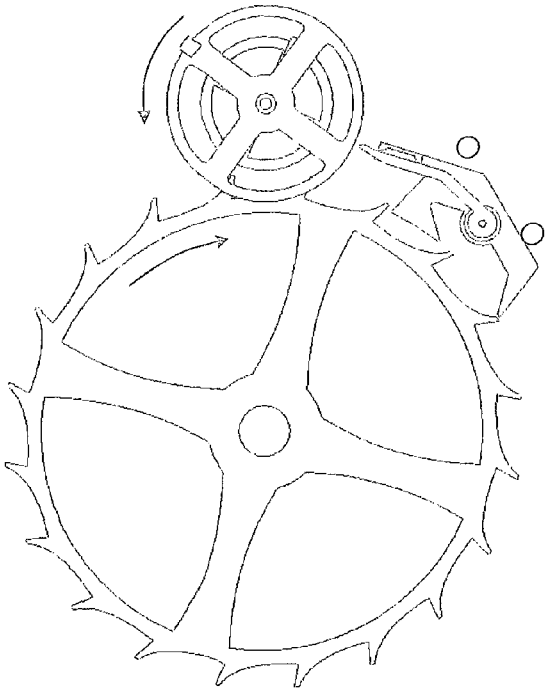
Figure 18:
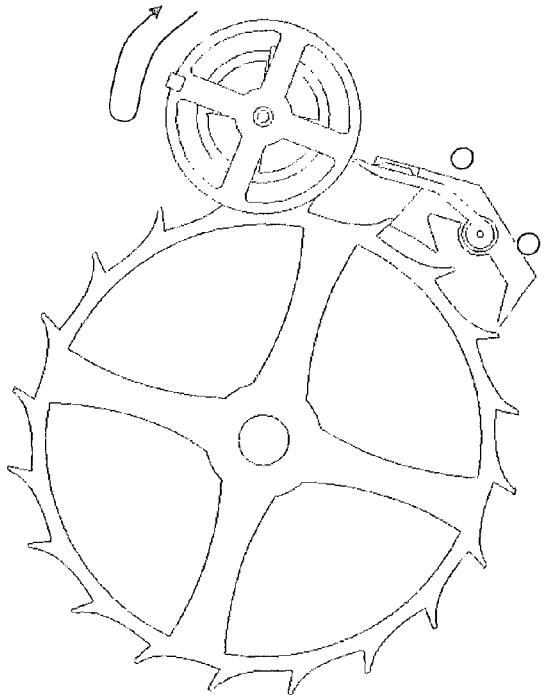
Figure 19:
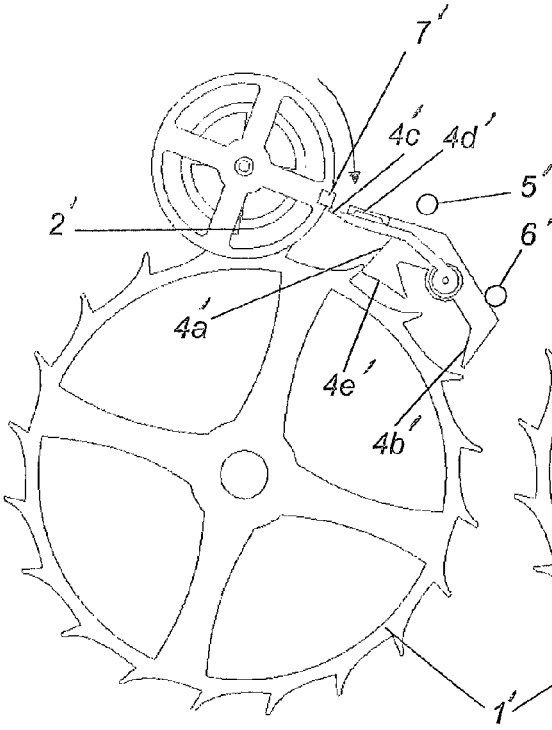
Figure 20:
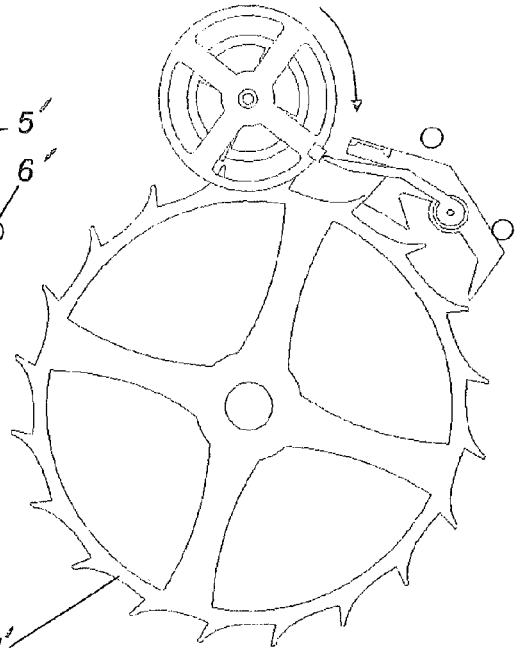
Figure 21:
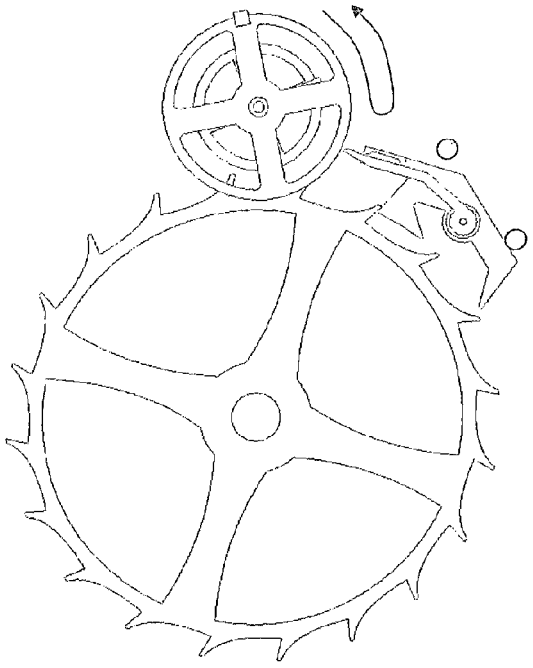

After the impulse phase, the escapement wheel 1' continues its rotation and one of its teeth encounters the sliding surface 4*b*' (FIG. 16). By sliding against this surface 4*b*', the tooth of the escapement wheel causes the rocker 4' to turn counterclockwise and brings it against the abutment 6' (FIG. 17). This rocking also brings the stop element of the rocker 4' to the trajectory of the teeth of the escapement wheel 1' so that a tooth of the escapement wheel butts against the abutment face 4*a*' of the stop element and exerts on the rocker 4' a torque which holds it against the abutment 6' (FIG. 18).

During this time, the balance wheel 3' has continued to turn counterclockwise until the hairspring stops it and makes it turn in the clockwise direction.

When the disengagement finger 7' encounters the elastic disengagement element 4*c'* of the detent rocker 4' (FIG. 19), it moves it away from the abutment 4*d'* (FIG. 20) without moving the detent rocker 4'. The impulse pallet 2' of the balance wheel 3' travels between two adjacent teeth of the escapement wheel 1' without coming into contact with them.

The balance wheel 3' continues its rotation until it is stopped by the hairspring and is driven counterclockwise (FIG. 21), thus beginning a new oscillation cycle.

The detent escapement shown in FIGS. 11 to 21 can be improved by the addition of a frame, of elastic strips, etc. in order to arrive at the escapement shown in FIG. 3. Thus, a flexible pivot is produced and practically all of the clearances associated with the movement of the immobilizer are eliminated, with an increase in the precision of the relative positioning of the constituent parts of the immobilizing device. The improved escapement has a specific behavior the primary object of which is to increase operating security.

The invention claimed is:

1. An immobilizing device for a toothed wheel comprising:

a frame;

an immobilizer comprising two arms each furnished with a pallet designed to come into contact with a tooth of the toothed wheel;

a first and a second elastic element each having one end connected to the immobilizer and another end connected to the frame;

a third elastic element connected to the immobilizer, the immobilizing device being formed all in one integral piece, or all in one integral piece except for at least one of the pallets.

2. The immobilizing device for a toothed wheel as claimed in claim 1, wherein the first and second elastic elements are each connected to an arm.

3. The immobilizing device for a toothed wheel as claimed in claim 1, wherein the third elastic element is connected to one of the arms in a location different from the junction zone of these arms.

4. The immobilizing device for a toothed wheel as claimed in claim 3, wherein the third elastic element is connected to the end of one of the arms.

5. The immobilizing device for a toothed wheel as claimed in claim 1, wherein the first and second elastic elements form an angle of 90° or an obtuse angle between them.

6. The immobilizing device for a toothed wheel as claimed in claim 1, wherein the first and second elastic elements are first and second flexible strips.

7. The immobilizing device for a toothed wheel as claimed in claim 1, wherein the third elastic element is a rigid block comprising, on two opposite sides, a third and a fourth flexible strip.

8. The immobilizing device for a toothed wheel as claimed in claim 1, wherein the third elastic element is also connected to the frame.

9. The immobilizing device for a toothed wheel as claimed in claim 7, wherein the fourth flexible strip is connected to an additional block, the latter being if necessary connected to the frame.

10. The immobilizing device for a toothed wheel (40) as claimed in claim 1, also comprising a prestress system applying a force to the third elastic element.

11. The immobilizing device for a toothed wheel as claimed in claim 10, wherein the prestress system is capable of causing the force applied to the third elastic element to vary.

12. The immobilizing device for a toothed wheel as claimed in claim 11, wherein the variable prestress system comprises an eccentric screw or a micrometric screw.

13. The immobilizing device for a toothed wheel as claimed in claim 11, wherein the variable prestress system comprises an additional block connected to the frame by fifth and sixth flexible strips or by means of an intermediate block itself connected to the frame by seventh and eighth strips.

14. The immobilizing device for a toothed wheel as claimed in claim 13, wherein the seventh and eighth strips are placed such that, during a movement of the four strips, their reductions in length cancel one another out, so as to prevent any untoward movement of the block when the prestress is adjusted.

15. The immobilizing device for a toothed wheel as claimed in claim 13, wherein the intermediate block comprises a post and the frame comprises a recess capable of accommodating the post and of delimiting its movements.

16. A timepiece comprising an immobilizing device for a toothed wheel as claimed in claim 1.

17. The timepiece as claimed in claim 16, the immobilizing device forming part of an escapement and the toothed wheel being an escapement wheel.

18. The immobilizing device for a toothed wheel as claimed in claim 1, wherein the immobilizing device is made all in a single integral block or the immobilizing device except at least one of the pallets is made all in a single integral block.

* * * * *